US009916825B2

(12) United States Patent
Edrenkin

(10) Patent No.: US 9,916,825 B2
(45) Date of Patent: Mar. 13, 2018

(54) METHOD AND SYSTEM FOR TEXT-TO-SPEECH SYNTHESIS

(71) Applicant: YANDEX EUROPE AG, Lucerne (CH)

(72) Inventor: Ilya Vladimirovich Edrenkin, Moscow (RU)

(73) Assignee: YANDEX EUROPE AG, Lucerne (CH)

( * ) Notice: Subject to any disclaimer, the term of this patent is extended or adjusted under 35 U.S.C. 154(b) by 0 days.

(21) Appl. No.: 15/263,525

(22) Filed: Sep. 13, 2016

(65) Prior Publication Data

US 2017/0092258 A1 Mar. 30, 2017

(30) Foreign Application Priority Data

Sep. 29, 2015 (RU) ..... 2015141342

(51) Int. Cl.
*G10L 13/08* (2013.01)
*G10L 13/033* (2013.01)
*G10L 13/047* (2013.01)

(52) U.S. Cl.
CPC ..... *G10L 13/08* (2013.01); *G10L 13/033* (2013.01); *G10L 13/047* (2013.01)

(58) Field of Classification Search
CPC ..... G10L 15/063; G10L 13/08; G10L 13/033; G10L 13/047
See application file for complete search history.

(56) References Cited

U.S. PATENT DOCUMENTS 5,860,064 A 1/1999 Henton
6,134,528 A * 10/2000 Miller ..... G06F 17/277 704/258

(Continued)

FOREIGN PATENT DOCUMENTS

EP 2650874 A1 10/2013
RU 2296377 C2 3/2007

(Continued)

OTHER PUBLICATIONS

Vocoder—Wikipedia, Sep. 21, 2015, Retrieved from the Internet: URL:https://en.wikipedia.org/w/index.php?title=Vocoder &oldid=682020055, retrieved on Jan. 30, 2017.

(Continued)

*Primary Examiner* — Matthew Baker
(74) *Attorney, Agent, or Firm* — BCF LLP

(57) ABSTRACT

There are disclosed methods and systems for text-to-speech synthesis for outputting a synthetic speech having a selected speech attribute. First, an acoustic space model is trained based on a set of training data of speech attributes, using a deep neural network to determine interdependency factors between the speech attributes in the training data, the dnn generating a single, continuous acoustic space model based on the interdependency factors, the acoustic space model thereby taking into account a plurality of interdependent speech attributes and allowing for modelling of a continuous spectrum of the interdependent speech attributes. Next, a text is received; a selection of one or more speech attribute is received, each speech attribute having a selected attribute weight; the text is converted into synthetic speech using the acoustic space model, the synthetic speech having the selected speech attribute; and the synthetic speech is outputted as audio having the selected speech attribute.

12 Claims, 4 Drawing Sheets

(56) References Cited

U.S. PATENT DOCUMENTS

| | | | | |
|---|---|---|---|---|
| 6,173,262 | B1 | 1/2001 | Hirschberg | |
| 6,446,040 | B1 | 9/2002 | Socher et al. | |
| 6,865,533 | B2 | 3/2005 | Addison et al. | |
| 7,580,839 | B2 | 8/2009 | Tamura et al. | |
| 7,979,280 | B2 | 7/2011 | Wouters et al. | |
| 8,135,591 | B2 | 3/2012 | Schroeter | |
| 8,527,276 | B1 | 9/2013 | Senior et al. | |
| 8,571,871 | B1 * | 10/2013 | Stuttle | G10L 13/033 704/260 |
| 8,655,659 | B2 | 2/2014 | Wang et al. | |
| 8,886,537 | B2 | 11/2014 | Goldberg et al. | |
| 9,195,656 | B2 * | 11/2015 | Fructuoso | G06F 17/289 |
| 9,600,231 | B1 * | 3/2017 | Sun | G06F 3/167 |
| 2009/0300041 | A1 | 12/2009 | Schroeter | |
| 2013/0026211 | A1 | 1/2013 | Fujita et al. | |
| 2013/0054244 | A1 | 2/2013 | Bao et al. | |
| 2013/0262119 | A1 | 10/2013 | Latorre-Martinez et al. | |
| 2014/0018848 | A1 | 1/2014 | Kladakis et al. | |
| 2014/0188480 | A1 | 7/2014 | Bangalore et al. | |
| 2015/0269927 | A1 | 9/2015 | Yamasaki | |
| 2016/0343366 | A1 * | 11/2016 | Fructuoso | G10L 13/08 |
| 2017/0092258 | A1 * | 3/2017 | Edrenkin | G10L 13/08 |
| 2017/0092259 | A1 * | 3/2017 | Jeon | G10L 13/08 |

FOREIGN PATENT DOCUMENTS

| | | | |
|---|---|---|---|
| RU | 2298234 | C2 | 4/2007 |
| RU | 2386178 | C2 | 6/2009 |
| RU | 2427044 | C2 | 8/2011 |
| WO | 2015092943 | A1 | 6/2015 |

OTHER PUBLICATIONS

European Search Report from EP 16190998, dated Jan. 21, 2017, Loza, Artur.

* cited by examiner

METHOD AND SYSTEM FOR TEXT-TO-SPEECH SYNTHESIS

CROSS-REFERENCE

The present application claims priority to Russian Patent Application No. 2015141342, filed Sep. 29, 2015, entitled "METHOD AND SYSTEM FOR TEXT-TO-SPEECH SYNTHESIS", the entirety of which is incorporated herein by reference.

FIELD

The present technology relates to a method and system for text-to-speech synthesis. In particular, methods and systems for outputting synthetic speech having one or more selected speech attribute are provided.

BACKGROUND

In text-to-speech (TTS) systems, a portion of text (or a text file) is converted into audio speech (or an audio speech file). Such systems are used in a wide variety of applications such as electronic games, e-book readers, e-mail readers, satellite navigation, automated telephone systems, and automated warning systems. For example, some instant messaging (IM) systems use TTS synthesis to convert text chat to speech. This can be very useful for people who have difficulty reading, people who are driving, or people who simply do not want to take their eyes off whatever they are doing to change focus to the IM window.

A problem with TTS synthesis is that the synthesized speech can lose attributes such as emotions, vocal expressiveness, and the speaker's identity. Often all synthesized voices will sound the same. There is a continuing need to make systems sound more like a natural human voice.

U.S. Pat. No. 8,135,591 issued on Mar. 13, 2012 describes a method and system for training a text-to-speech synthesis system for use in speech synthesis. The method includes generating a speech database of audio files comprising domain-specific voices having various prosodies, and training a text-to-speech synthesis system using the speech database by selecting audio segments having a prosody based on at least one dialog state. The system includes a processor, a speech database of audio files, and modules for implementing the method.

U.S. Patent Application Publication No. 2013/0262119 published on Oct. 3, 2013 teaches a text-to-speech method configured to output speech having a selected speaker voice and a selected speaker attribute. The method includes inputting text; dividing the inputted text into a sequence of acoustic units; selecting a speaker for the inputted text; selecting a speaker attribute for the inputted text; converting the sequence of acoustic units to a sequence of speech vectors using an acoustic model; and outputting the sequence of speech vectors as audio with the selected speaker voice and the selected speaker attribute. The acoustic model includes a first set of parameters relating to speaker voice and a second set of parameters relating to speaker attributes, which parameters do not overlap. Selecting a speaker voice includes selecting parameters from the first set of parameters and selecting the speaker attribute includes selecting the parameters from the second set of parameters. The acoustic model is trained using a cluster adaptive training method (CAT) where the speakers and speaker attributes are accommodated by applying weights to model parameters which have been arranged into clusters, a decision tree being constructed for each cluster. Embodiments where the acoustic model is a Hidden Markov Model (HMM) are described.

U.S. Pat. No. 8,886,537 issued on Nov. 11, 2014 describes a method and system for text-to-speech synthesis with personalized voice. The method includes receiving an incidental audio input of speech in the form of an audio communication from an input speaker and generating a voice dataset for the input speaker. A text input is received at the same device as the audio input and the text is synthesized from the text input to synthesized speech using a voice dataset to personalize the synthesized speech to sound like the input speaker. In addition, the method includes analyzing the text for expression and adding the expression to the synthesized speech. The audio communication may be part of a video communication and the audio input may have an associated visual input of an image of the input speaker. The synthesis from text may include providing a synthesized image personalized to look like the image of the input speaker with expressions added from the visual input.

SUMMARY

It is thus an object of the present technology to ameliorate at least some of the inconveniences present in the prior art.

In one aspect, implementations of the present technology provide a method for text-to-speech synthesis (TTS) configured to output a synthetic speech having a selected speech attribute. The method is executable at a computing device. The method first comprises the following steps for training an acoustic space model: a) receiving a training text data and a respective training acoustic data, the respective training acoustic data being a spoken representation of the training text data, the respective training acoustic data being associated with one or more defined speech attribute; b) extracting one or more of phonetic and linguistic features of the training text data; c) extracting vocoder features of the respective training acoustic data, and correlating the vocoder features with the phonetic and linguistic features of the training text data and with the one or more defined speech attribute, thereby generating a set of training data of speech attributes; and d) using a deep neural network (dnn) to determine interdependency factors between the speech attributes in the training data. The dnn generates a single, continuous acoustic space model based on the interdependency factors, the acoustic space model thereby taking into account a plurality of interdependent speech attributes and allowing for modelling of a continuous spectrum of the interdependent speech attributes.

The method further comprises the following steps for TTS using the acoustic space model: e) receiving a text; f) receiving a selection of a speech attribute, the speech attribute having a selected attribute weight; g) converting the text into synthetic speech using the acoustic space model, the synthetic speech having the selected speech attribute; and h) outputting the synthetic speech as audio having the selected speech attribute.

In some embodiments, extracting one or more of phonetic and linguistic features of the training text data comprises dividing the training text data into phones. In some embodiments, extracting vocoder features of the respective training acoustic data comprises dimensionality reduction of the waveform of the respective training acoustic data.

One or more speech attribute may be defined during the training steps. Similarly, one or more speech attribute may be selected during the conversion/speech synthesis steps.

Non-limiting examples of speech attributes include emotions, genders, intonations, accents, speaking styles, dynamics, and speaker identities. In some embodiments, two or more speech attributes are defined or selected. Each selected speech attribute has a respective selected attribute weight. In embodiments where two or more speech attributes are selected, the outputted synthetic speech has each of the two or more selected speech attributes.

In some embodiments, the method further comprises the steps of: receiving a second text; receiving a second selected speech attribute, the second selected speech attribute having a second selected attribute weight; converting the second text into a second synthetic speech using the acoustic space model, the second synthetic speech having the second selected speech attribute; and outputting the second synthetic speech as audio having the second selected speech attribute.

In another aspect, implementations of the present technology provide a server. The server comprises an information storage medium; a processor operationally connected to the information storage medium, the processor configured to store objects on the information storage medium. The processor is further configured to: a) receive a training text data and a respective training acoustic data, the respective training acoustic data being a spoken representation of the training text data, the respective training acoustic data being associated with one or more defined speech attribute; b) extract one or more of phonetic and linguistic features of the training text data; c) extract vocoder features of the respective training acoustic data, and correlate the vocoder features with the phonetic and linguistic features of the training text data and with the one or more defined speech attribute, thereby generating a set of training data of speech attributes; and d) use a deep neural network (dnn) to determine interdependency factors between the speech attributes in the training data, the dnn generating a single, continuous acoustic space model based on the interdependency factors, the acoustic space model thereby taking into account a plurality of interdependent speech attributes and allowing for modelling of a continuous spectrum of the interdependent speech attributes.

The processor is further configured to: e) receive a text; f) receive a selection of a speech attribute, the speech attribute having a selected attribute weight; g) convert the text into synthetic speech using the acoustic space model, the synthetic speech having the selected speech attribute; and h) output the synthetic speech as audio having the selected speech attribute.

In the context of the present specification, unless specifically provided otherwise, a "server" is a computer program that is running on appropriate hardware and is capable of receiving requests (e.g., from client devices) over a network, and carrying out those requests, or causing those requests to be carried out. The hardware may be one physical computer or one physical computer system, but neither is required to be the case with respect to the present technology. In the present context, the use of the expression a "server" is not intended to mean that every task (e.g., received instructions or requests) or any particular task will have been received, carried out, or caused to be carried out, by the same server (i.e., the same software and/or hardware); it is intended to mean that any number of software elements or hardware devices may be involved in receiving/sending, carrying out or causing to be carried out any task or request, or the consequences of any task or request; and all of this software and hardware may be one server or multiple servers, both of which are included within the expression "at least one server".

In the context of the present specification, unless specifically provided otherwise, a "client device" is an electronic device associated with a user and includes any computer hardware that is capable of running software appropriate to the relevant task at hand. Thus, some (non-limiting) examples of client devices include personal computers (desktops, laptops, netbooks, etc.), smartphones, and tablets, as well as network equipment such as routers, switches, and gateways. It should be noted that a computing device acting as a client device in the present context is not precluded from acting as a server to other client devices. The use of the expression "a client device" does not preclude multiple client devices being used in receiving/sending, carrying out or causing to be carried out any task or request, or the consequences of any task or request, or steps of any method described herein.

In the context of the present specification, unless specifically provided otherwise, a "computing device" is any electronic device capable of running software appropriate to the relevant task at hand. A computing device may be a server, a client device, etc.

In the context of the present specification, unless specifically provided otherwise, a "database" is any structured collection of data, irrespective of its particular structure, the database management software, or the computer hardware on which the data is stored, implemented or otherwise rendered available for use. A database may reside on the same hardware as the process that stores or makes use of the information stored in the database or it may reside on separate hardware, such as a dedicated server or plurality of servers.

In the context of the present specification, unless specifically provided otherwise, the expression "information" includes information of any nature or kind whatsoever, comprising information capable of being stored in a database. Thus information includes, but is not limited to audiovisual works (photos, movies, sound records, presentations etc.), data (map data, location data, numerical data, etc.), text (opinions, comments, questions, messages, etc.), documents, spreadsheets, etc.

In the context of the present specification, unless specifically provided otherwise, the expression "component" is meant to include software (appropriate to a particular hardware context) that is both necessary and sufficient to achieve the specific function(s) being referenced.

In the context of the present specification, unless specifically provided otherwise, the expression "information storage medium" is intended to include media of any nature and kind whatsoever, including RAM, ROM, disks (CD-ROMs, DVDs, floppy disks, hard drivers, etc.), USB keys, solid state-drives, tape drives, etc.

In the context of the present specification, unless specifically provided otherwise, the expression "vocoder" is meant to refer to an audio processor that analyzes speech input by determining the characteristic elements (such as frequency components, noise components, etc.) of an audio signal. In some cases, a vocoder can be used to synthesize a new audio output based on an existing audio sample by adding the characteristic elements to the existing audio sample. In other words, a vocoder can use the frequency spectrum of one audio sample to modulate the same in another audio sample. "Vocoder features" refer to the characteristic elements of an audio sample determined by a vocoder, e.g., the characteristics of the waveform of an audio sample such as frequency, etc.

In the context of the present specification, unless specifically provided otherwise, the expression "text" is meant to refer to a human-readable sequence of characters and the words they form. A text can generally be encoded into computer-readable formats such as ASCII. A text is generally distinguished from non-character encoded data, such as graphic images in the form of bitmaps and program code. A text may have many different forms, for example it may be a written or printed work such as a book or a document, an email message, a text message (e.g., sent using an instant messaging system), etc.

In the context of the present specification, unless specifically provided otherwise, the expression "acoustic" is meant to refer to sound energy in the form of waves having a frequency, the frequency generally being in the human hearing range. "Audio" refers to sound within the acoustic range available to humans. "Speech" and "synthetic speech" are generally used herein to refer to audio or acoustic, e.g., spoken, representations of text. Acoustic and audio data may have many different forms, for example they may be a recording, a song, etc. Acoustic and audio data may be stored in a file, such as an MP3 file, which file may be compressed for storage or for faster transmission.

In the context of the present specification, unless specifically provided otherwise, the expression "speech attribute" is meant to refer to a voice characteristic such as emotion, speaking style, accent, identity of speaker, intonation, dynamic, or speaker trait (gender, age, etc.). For example, a speech attribute may be angry, sad, happy, neutral emotion, nervous, commanding, male, female, old, young, gravelly, smooth, rushed, fast, loud, soft, a particular regional or foreign accent, and the like. Many speech attributes are possible. Further, a speech attribute may be variable over a continuous range, for example intermediate between "sad" and "happy" or "sad" and "angry".

In the context of the present specification, unless specifically provided otherwise, the expression "deep neural network" is meant to refer to a system of programs and data structures designed to approximate the operation of the human brain. Deep neural networks generally comprise a series of algorithms that can identify underlying relationships and connections in a set of data using a process that mimics the way the human brain operates. The organization and weights of the connections in the set of data generally determine the output. A deep neural network is thus generally exposed to all input data or parameters at once, in their entirety, and is therefore capable of modeling their interdependencies. In contrast to machine learning algorithms that use decision trees and are therefore constrained by their limitations, deep neural networks are unconstrained and therefore suited for modelling interdependencies.

In the context of the present specification, unless specifically provided otherwise, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first server" and "third server" is not intended to imply any particular order, type, chronology, hierarchy or ranking (for example) of/between the server, nor is their use (by itself) intended imply that any "second server" must necessarily exist in any given situation. Further, as is discussed herein in other contexts, reference to a "first" element and a "second" element does not preclude the two elements from being the same actual real-world element. Thus, for example, in some instances, a "first" server and a "second" server may be the same software and/or hardware, in other cases they may be different software and/or hardware.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
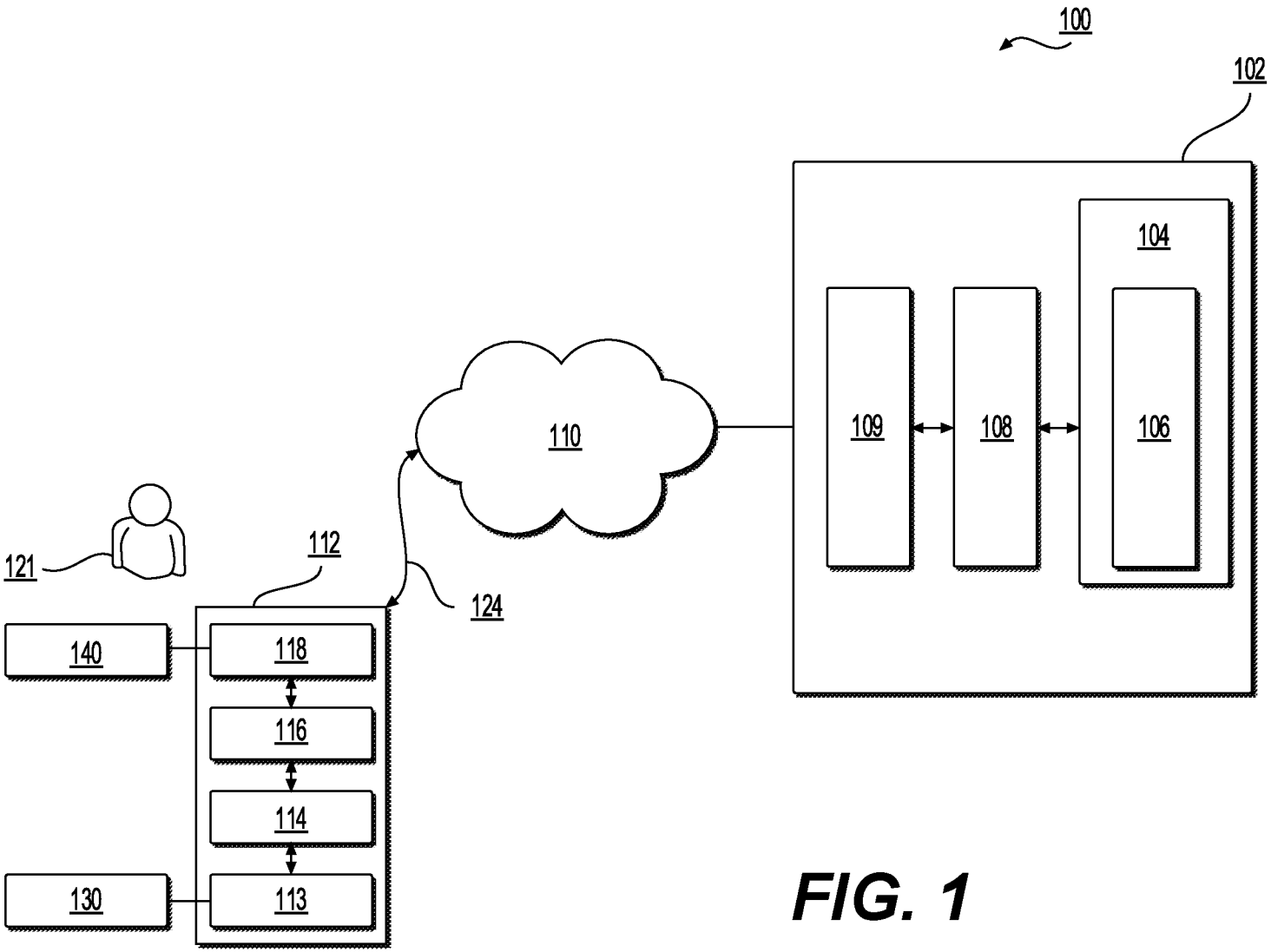
FIG. 1 is a schematic diagram of a system implemented in accordance with a non-limiting embodiment of the present technology.

Referring to FIG. 1, there is shown a diagram of a system 100, the system 100 being suitable for implementing non-limiting embodiments of the present technology. It is to be expressly understood that the system 100 is depicted as merely as an illustrative implementation of the present technology. Thus, the description thereof that follows is intended to be only a description of illustrative examples of the present technology. This description is not intended to define the scope or set forth the bounds of the present technology. In some cases, what are believed to be helpful examples of modifications to the system 100 may also be set forth below. This is done merely as an aid to understanding, and, again, not to define the scope or set forth the bounds of the present technology. These modifications are not an exhaustive list, and, as a person skilled in the art would understand, other modifications are likely possible. Further, where this has not been done (i.e., where no examples of modifications have been set forth), it should not be interpreted that no modifications are possible and/or that what is described is the sole manner of implementing that element of the present technology. As a person skilled in the art would understand, this is likely not the case. In addition it is to be understood that the system 100 may provide in certain instances simple implementations of the present technology, and that where such is the case they have been presented in this manner as an aid to understanding. As persons skilled in the art would understand, various implementations of the present technology may be of a greater complexity.

System 100 includes a server 102. The server 102 may be implemented as a conventional computer server. In an example of an embodiment of the present technology, the server 102 may be implemented as a Dell™ PowerEdge™ Server running the Microsoft™ Windows Server™ operating system. Needless to say, the server 102 may be implemented in any other suitable hardware and/or software and/or firmware or a combination thereof. In the depicted non-limiting embodiment of the present technology, the server 102 is a single server. In alternative non-limiting embodiments of the present technology, the functionality of the server 102 may be distributed and may be implemented via multiple servers.

In some implementations of the present technology, the server 102 can be under control and/or management of a provider of an application using text-to-speech (TTS) synthesis, e.g., an electronic game, an e-book reader, an e-mail reader, a satellite navigation system, an automated telephone system, an automated warning system, an instant messaging system, and the like. In alternative implementations the server 102 can access an application using TTS synthesis provided by a third-party provider. In yet other implementations, the server 102 can be under control and/or management of, or can access, a provider of TTS services and other services incorporating TTS.

The server 102 includes an information storage medium 104 that may be used by the server 102. Generally, the information storage medium 104 may be implemented as a medium of any nature and kind whatsoever, including RAM, ROM, disks (CD-ROMs, DVDs, floppy disks, hard drivers, etc.), USB keys, solid state-drives, tape drives, etc. and also the combinations thereof.

The implementations of the server 102 are well known in the art. So, suffice it to state, that the server 102 comprises inter alia a network communication interface 109 (such as a modem, a network card and the like) for two-way communication over a communication network 110; and a processor 108 coupled to the network communication interface 109 and the information storage medium 104, the processor 108 being configured to execute various routines, including those described herein below. To that end the processor 108 may have access to computer readable instructions stored on the information storage medium 104, which instructions, when executed, cause the processor 108 to execute the various routines described herein.

In some non-limiting embodiments of the present technology, the communication network 110 can be implemented as the Internet. In other embodiments of the present technology, the communication network 110 can be implemented differently, such as any wide-area communication network, local-area communication network, a private communication network and so on.

The information storage medium 104 is configured to store data, including computer-readable instructions and other data, including text data, audio data, acoustic data, and the like. In some implementations of the present technology, the information storage medium 104 can store at least part of the data in a database 106. In other implementations of the present technology, the information storage medium 104 can store at least part of the data in any collections of data other than databases.

The information storage medium 104 can store computer-readable instructions that manage updates, population and modification of the database 106 and/or other collections of data. More specifically, computer-readable instructions stored on the information storage medium 104 allow the server 102 to receive (e.g., to update) information in respect of text and audio samples via the communication network 110 and to store information in respect of the text and audio samples, including the information in respect of their phonetic features, linguistic features, vocoder features, speech attributes, etc., in the database 106 and/or in other collections of data.

Data stored on the information storage medium 104 (and more particularly, at least in part, in some implementations, in the database 106) can comprise inter alia text and audio samples of any kind. Non-limiting examples of text and/or audio samples include books, articles, journals, emails, text messages, written reports, voice recordings, speeches, video games, graphics, spoken text, songs, videos, and audiovisual works.

Computer-readable instructions, stored on the information storage medium 104, when executed, can cause the processor 108 to receive instruction to output a synthetic speech 440 having a selected speech attribute 420. The instruction to output the synthetic speech 440 having the selected speech attribute 420 can be instructions of a user 121 received by the server 102 from a client device 112, which client device 112 will be described in more detail below. The instruction to output the synthetic speech 440 having the selected speech attribute 420 can be instructions of the client device 112 received by the server 102 from client device 112. For example, responsive to user 121 requesting to have text messages read aloud by the client device 112, the client device 112 can send to the server 102 a corresponding request to output incoming text messages as synthetic speech 440 having the selected speech attribute 420, to be provided to the user 121 via the output module 118 and the audio output 140 of the client device 112.

Computer-readable instructions, stored on the information storage medium 104, when executed, can further cause the processor 108 to convert a text into synthetic speech 440 using an acoustic space model 340, the synthetic speech 440 having a selected speech attribute 420. Broadly speaking, this conversion process can be broken into two portions: a training process in which the acoustic space model 340 is generated (generally depicted in FIG. 3), and an "in-use" process in which the acoustic space model 340 is used to convert a received text 410 into synthetic speech 440 having selected speech attributes 420 (generally depicted in FIG. 4). We will discuss each portion in turn.

In the training process, computer-readable instructions, stored on the information storage medium 104, when executed, can cause the processor 108 to receive a training text data 312 and a respective training acoustic data 322. The form of the training text data 312 is not particularly limited and may be, for example, part of a written or printed text 410 of any type, e.g., a book, an article, an e-mail, a text 410 message, and the like. In some embodiments, the training text data 312 is received via text input 130 and input module 113. In alternative embodiments, the training text data 312 is received via a second input module (not depicted) in the server (102). The training text data 312 may be received from an e-mail client, an e-book reader, a messaging system, a web browser, or within another application containing text content. Alternatively, the training text data 312 may be received from the operating system of the computing device (e.g., the server 102, or the client device 112). The form of the training acoustic data 322 is also not particularly limited and may be, for example, a recording of a person reading aloud the training text data 312, a recorded speech, a play, a song, a video, and the like.

The training acoustic data 322 is a spoken (e.g., audio) representation of the training text data 312, and is associated with one or more defined speech attribute, the one or more defined speech attribute describing characteristics of the training acoustic data 322. The one or more defined speech attribute is not particularly limited and may correspond, for example, to an emotion (angry, happy, sad, etc.), the gender of the speaker, an accent, an intonation, a dynamic (loud, soft, etc.), a speaker identity, etc. Training acoustic data 322 may be received as any type of audio sample, for example a recording, a MP3 file, and the like. In some embodiments, the training acoustic data 322 is received via an audio input (not depicted) and input module 113. In alternative embodiments, the training acoustic data 322 is received via a second input module (not depicted) in the server (102). The training acoustic data 322 may be received from an application containing audio content. Alternatively, the training acoustic data 322 may be received from the operating system of the computing device (e.g., the server 102, or the client device 112).

Training text data 312 and training acoustic data 322 can originate from multiple sources. For example, training text and/or acoustic data could be retrieved from email messages, downloaded from a remote server, and the like. In some non-limiting implementations, training text and/or acoustic data is stored in the information storage medium 104, e.g., in database 106. In alternative non-limiting implementations, training text and/or acoustic data is received (e.g., uploaded) by the server 102 from the client device 112 via the communication network 110. In yet another non-limiting implementation, training text and/or acoustic data is retrieved (e.g., downloaded) from an external resource (not depicted) via the communication network 110. In yet another embodiment, training text data 312 is inputted by the user 121 via text input 130 and input module 113. Similarly, training acoustic data 322 may be inputted by the user 121 via an audio input (not depicted) connected to input module 113.

In this implementation of the present technology, the server 102 acquires the training text and/or acoustic data from an external resource (not depicted), which can be, for example, a provider of such data. It should be expressly understood that the source of the training text and/or acoustic data can be any suitable source, for example, any device that optically scans text images and converts them to a digital image, any device that records audio samples, and the like.

One or more training text data 312 may be received. In some non-limiting implementations, two or more training text data 312 are received. In some non-limiting implementations, two or more respective training acoustic data 322 may be received for each training text data 312 received, each training acoustic data 322 being associated with one or more defined speech attribute. In such implementations, each training acoustic data 322 may have distinct defined speech attributes. For example, a first training acoustic data 322 being a spoken representation of a first training text data 312 may have the defined speech attributes "male" and "angry" (i.e., a recording of the first training text data 312 read out-loud by an angry man), whereas a second training acoustic data 322, the second training acoustic data 322 also being a spoken representation of the first training text data 312, may have the define speech attributes "female", "happy", and "young" (i.e., a recording of the first training text data 312 read out-loud by a young girl who is feeling very happy). The number and type of speech attributes is defined independently for each training acoustic data 322.

Computer-readable instructions, stored on the information storage medium 104, when executed, can further cause the processor 108 to extract one or more of phonetic and linguistic features of the training text data 312. For example, in some embodiments the processor 108 can be caused to divide the training text data 312 into phones, a phone being a minimal segment of a speech sound in a language (such as a vowel or a consonant). As will be understood by persons skilled in the art, many phonetic and/or linguistic features may be extracted, and there are many methods known for doing so; neither the phonetic and/or linguistic features extracted nor the method for doing so is meant to be particularly limited.

Computer-readable instructions, stored on the information storage medium 104, when executed, can further cause the processor 108 to extract vocoder features of the respective training acoustic data 322 and correlate the vocoder features with the one or more phonetic and linguistic feature of the training text data and with the one or more defined speech attribute. A set of training data of speech attributes is thereby generated. In some non-limiting implementations, extracting vocoder features of the training acoustic data comprises dimensionality reduction of the waveform of the respective training acoustic data. As will be understood by persons skilled in the art, extraction of vocoder features may be done using many different methods, and the method used is not meant to be particularly limited.

Computer-readable instructions, stored on the information storage medium 104, when executed, can further cause the processor 108 to use a deep neural network (dnn) to determine interdependency factors between the speech attributes in the training data. The dnn (as described further below), generates a single, continuous acoustic space model that takes into account a plurality of interdependent speech attributes and allows for modelling of a continuous spectrum of interdependent speech attributes. Implementation of the dnn is not particularly limited. Many such machine learning algorithms are known. In some non-limiting implementations, the acoustic space model, once generated, is stored in the information storage medium 104, e.g., in database 106, for future use in the "in-use" portion of the TTS process.

The training portion of the TTS process is thus complete, the acoustic space model having been generated. We will now describe the system for the "in-use" portion of the TTS process in which the acoustic space model is used to convert a received text into synthetic speech having selected speech attributes.

Computer-readable instructions, stored on the information storage medium 104, when executed, can further cause the processor 108 to receive a text 410. As for the training text data 312, the form and origin of the text 410 is not particularly limited. The text 410 may be part of a written text of any type, e.g., a book, an article, an e-mail, a text message, and the like. In some non-limiting implementations, the text 410 is received via text input 130 and input module 113 of the client device 112. The text 410 may be received from an e-mail client, an e-book reader, a messaging system, a web browser, or within another application containing text content. Alternatively, the text 410 may be input by the user 121 via text input 130. In alternative non-limiting implementations, the text 410 is received from the operating system of the computing device (e.g., the server 102, or the client device 112).

Computer-readable instructions, stored on the information storage medium 104, when executed, can further cause the processor 108 to receive a selection of a speech attribute 420, the speech attribute 420 having a selected attribute weight. One or more speech attribute 420 may be received, each having one or more selected attribute weight. The selected attribute weight defines the weight of the speech attribute 420 desired in the synthetic speech to be outputted. In other words, the synthetic speech will have a weighted sum of speech attributes 420. Further, a speech attribute 420 may be variable over a continuous range, for example intermediate between "sad" and "happy" or "sad" and "angry".

In some non-limiting implementations, the selected speech attribute 420 is received via the input module 113 of the client device 112. In some non-limiting implementations, the selected speech attribute 420 is received with the text 410. In alternative embodiments, the text 410 and the selected speech attribute 420 are received separately (e.g., at different times, or from different applications, or from different users, or in different files, etc.), via the input module 113. In further non-limiting implementations, the selected speech attribute 420 is received via a second input module (not depicted) in the server 102.

It should be expressly understood that the selected speech attribute 420 is not particularly limited and may correspond, for example, to an emotion (angry, happy, sad, etc.), the gender of the speaker, an accent, an intonation, a dynamic, a speaker identity, a speaking style, etc, or any combination thereof.

Computer-readable instructions, stored on the information storage medium 104, when executed, can further cause the processor 108 to convert the text 410 into synthetic speech 440 using the acoustic space model 340 generated during the training process. In other words, the text 410 and the selected one or more speech attributes 420 are inputted into the acoustic space model 340, which outputs the synthetic speech having the selected speech attribute (as described further below). It should be understood that any desired speech attributes can be selected and used to included in the outputted synthetic speech.

Computer-readable instructions, stored on the information storage medium 104, when executed, can further cause the processor 108 to send to the client device 112 an instruction to output the synthetic speech as audio having the selected speech attribute 420, e.g., via the output module 118 and audio output 140 of the client device 112. The instruction can be sent via communication network 110. In some non-limiting implementations, the processor 108 can send instruction to output the synthetic speech as audio using a second output module (not depicted) in the server 102, e.g., connected to the network communication interface 109 and the processor 108. In some non-limiting implementations, instruction to output the synthetic speech via output module 118 and audio output 140 of the client device 112 is sent to client device 112 via the second output module (not depicted) in the server 102.

Computer-readable instructions, stored on the information storage medium 104, when executed, can further cause the processor 108 to repeat the "in-use" process in which the acoustic space model 340 is used to convert a received text 410 into synthetic speech having selected speech attributes 420 repeatedly, until all received texts 410 have been outputted as synthetic speech having the selected speech attributes 420. The number of texts 410 that can be received and outputted as synthetic speech using the acoustic space model 340 is not particularly limited.

The system 100 further comprises a client device 112. The client device 112 is typically associated with a user 121. It should be noted that the fact that the client device 112 is associated with the user 121 does not need to suggest or imply any mode of operation—such as a need to log in, a need to be registered or the like.

The implementation of the client device 112 is not particularly limited, but as an example, the client device 112 may be implemented as a personal computer (desktops, laptops, netbooks, etc.) or as a wireless communication device (a smartphone, a tablet and the like).

The client device 112 comprises an input module 113. How the input module 113 is implemented is not particularly limited and may depend on how the client device 112 is implemented. The input module 113 may include any mechanism for providing user input to the processor 116 of the client device 112. The input module 113 is connected to a text input 130. The text input 130 receives text. The text input 130 is not particularly limited and may depend on how the client device 112 is implemented. For example, the text input 130 can be a keyboard, and/or a mouse, and so on. Alternatively, the text input 130 can be a means for receiving text data from an external storage medium or a network. The text input 130 is not limited to any specific input methodology or device. For example, it could be arranged by a virtual button on a touch-screen display or a physical button on the cover of the electronic device, for instance. Other implementations are possible.

Merely as an example and not as a limitation, in those embodiments of the present technology where the client device 112 is implemented as a wireless communication device (such as a smartphone), text input 130 can be implemented as an optical interference based user input device. The text input 130 of one example is a finger/object movement sensing device on which a user performs a gesture and/or presses with a finger. The text input 130 can identify/track the gesture and/or determines a location of a user's finger on the client device 112. In the instances where the text input 130 is executed as the optical interference based user input device, such as a touch screen or multi-touch display, the input module 113 can further execute functions of the output module 118, particularly in embodiments where the output module 118 is implemented as a display screen.

The input module 113 is also connected to an audio input (not depicted) for inputting acoustic data. The audio input is not particularly limited and may depend on how the client device 112 is implemented. For example, the audio input can be a microphone, a recording device, an audio receiver, and the like. Alternatively, the audio input can be a means for receiving acoustic data from an external storage medium or a network such as a cassette tape, a compact disc, a radio, a digital audio source, an MP3 file, etc. The audio input is not limited to any specific input methodology or device.

The input module 113 is communicatively coupled to a processor 116 and transmits input signals based on various forms of user input for processing and analysis by processor 116. In embodiments where the input module 113 also operates as the output module 118, being implemented for example as a display screen, the input module 113 can also transmit output signal.

The client device 112 further comprises a computer usable information storage medium (also referred to as a local memory 114). Local memory 114 can comprise any type of media, including but not limited to RAM, ROM, disks (CD-ROMs, DVDs, floppy disks, hard drivers, etc.), USB keys, solid state-drives, tape drives, etc. Generally speaking, the purpose of the local memory 114 is to store computer readable instructions as well as any other data.

The client device 112 further comprises the output module 118. In some embodiments, the output module 118 can be implemented as a display screen. A display screen may be, for example, a liquid crystal display (LCD), a light emitting diode (LED), an interferometric modulator display (IMOD), or any other suitable display technology. A display screen is generally configured to display a graphical user interface (GUI) that provides an easy to use visual interface between the user 121 of the client device 112 and the operating system or application(s) running on the client device 112. Generally, a GUI presents programs, files and operational options with graphical images. Output module 118 is also generally configured to display other information like user data and web resources on a display screen. When output module 118 is implemented as a display screen, it can also be implemented as a touch based device such as a touch screen. A touch screen is a display that detects the presence and location of user touch inputs. A display screen can be a dual touch or multi-touch display that can identify the presence, location and movement of touch inputs. In the instances where the output module 118 is implemented as a touch-based device such as a touch screen, or a multi-touch display, the display screen can execute functions of the input module 113.

The output module 118 further comprises an audio output device such as a sound card or an external adaptor for processing audio data and a device for connecting to an audio output 140, the output module 118 being connected to the audio output 140. The audio output 140 may be, for example, a direct audio output such as a speaker, headphones, HDMI audio, or a digital output, such as an audio data file which may be sent to a storage medium, networked, etc. The audio output is not limited to any specific output methodology or device and may depend on how the client device 112 is implemented.

The output module 118 is communicatively coupled to the processor 116 and receives signals from the processor 116. In instances where the output module 118 is implemented as a touch-based display screen device such as a touch screen, or a multi-touch display, the output module 118 can also transmit input signals based on various forms of user input for processing and analysis by processor 116.

The client device 112 further comprises the above mentioned processor 116. The processor 116 is configured to perform various operations in accordance with a machine-readable program code. The processor 116 is operatively coupled to the input module 113, to the local memory 114, and to the output module 118. The processor 116 is configured to have access to computer readable instructions which instructions, when executed, cause the processor 116 to execute various routines.

As non-limiting examples, the processor 116 described herein can have access to computer readable instructions, which instructions, when executed, can cause the processor 116 to: output a synthetic speech as audio via the output module 118; receive from a user 121 of the client device 112 via the input module 113 a selection of text and selected speech attribute(s); send, by the client device 112 to a server 102 via a communication network 110, the user-inputted data; and receive, by the client device 112 from the server 102 a synthetic speech for outputting via the output module 118 and audio output 140 of the client device 112.

The local memory 114 is configured to store data, including computer-readable instructions and other data, including text and acoustic data. In some implementations of the present technology, the local memory 114 can store at least part of the data in a database (not depicted). In other implementations of the present technology, the local memory 114 can store at least part of the data in any collections of data (not depicted) other than databases.

Data stored on the local memory 114 (and more particularly, at least in part, in some implementations, in the database) can comprise text and acoustic data of any kind.

The local memory 114 can store computer-readable instructions that control updates, population and modification of the database (not depicted) and/or other collections of data (not depicted). More specifically, computer-readable instructions stored on the local memory 114 allow the client device 112 to receive (e.g., to update) information in respect of text and acoustic data and synthetic speech, via the communication network 110, to store information in respect of the text and acoustic data and synthetic speech, including the information in respect of their phonetic and linguistic features, vocoder features, and speech attributes in the database, and/or in other collections of data.

Computer-readable instructions, stored on the local memory 114, when executed, can cause the processor 116 to receive instruction to perform TTS. The instruction to perform TTS can be received following instructions of a user 121 received by the client device 112 via the input module 113. For example, responsive to user 121 requesting to have text messages read out-loud, the client device 112 can send to the server 102 a corresponding request to perform TTS.

In some implementations of the present technology, instruction to perform TTS can be executed on the server 102, so that the client device 112 transmits the instructions to the server 102. Further, computer-readable instructions, stored on the local memory 114, when executed, can cause the processor 116 to receive, from the server 102, as a result of processing by the server 102, an instruction to output a synthetic speech via audio output 140. The instruction to output the synthetic speech as audio via audio output 140 can be received from the server 102 via communication network 110. In some implementations, the instruction to output the synthetic speech as audio via audio output 140 of the client device 112 may comprise an instruction to read incoming text messages out-loud. Many other implementations are possible and these are not meant to be particularly limited.

In alternative implementations of the present technology, an instruction to perform TTS can be executed locally, on the client device 112, without contacting the server 102.

More particularly, computer-readable instructions, stored on the local memory 114, when executed, can cause the processor 116 to receive a text, receive one or more selected speech attributes, etc. In some implementations, the instruction to perform TTS can be instructions of a user 121 entered using the input module 113. For example, responsive to user 121 requesting to read text messages out-loud, the client device 112 can receive instruction to perform TTS.

Computer-readable instructions, stored on the local memory 114, when executed, can further cause the processor 116 to execute other steps in the TTS method, as described herein; these steps are not described again here to avoid unnecessary repetition.

It is noted that the client device 112 is coupled to the communication network 110 via a communication link 124. In some non-limiting embodiments of the present technology, the communication network 110 can be implemented as the Internet. In other embodiments of the present technology, the communication network 110 can be implemented differently, such as any wide-area communications network, local-area communications network, a private communications network and the like. The client device 112 can establish connections, through the communication network 110, with other devices, such as servers. More particularly, the client device 112 can establish connections and interact with the server 102.

How the communication link 124 is implemented is not particularly limited and will depend on how the client device 112 is implemented. Merely as an example and not as a limitation, in those embodiments of the present technology where the client device 112 is implemented as a wireless communication device (such as a smartphone), the communication link 124 can be implemented as a wireless communication link (such as but not limited to, a 3G communications network link, a 4G communications network link, a Wireless Fidelity, or WiFi® for short, Bluetooth® and the like). In those examples, where the client device 112 is implemented as a notebook computer, the communication link 124 can be either wireless (such as the Wireless Fidelity, or WiFi® for short, Bluetooth® or the like) or wired (such as an Ethernet based connection).

It should be expressly understood that implementations for the client device 112, the communication link 124 and the communication network 110 are provided for illustration purposes only. As such, those skilled in the art will easily appreciate other specific implementation details for the client device 112, the communication link 124 and the communication network 110. As such, by no means are examples provided herein above meant to limit the scope of the present technology.

Figure 2:
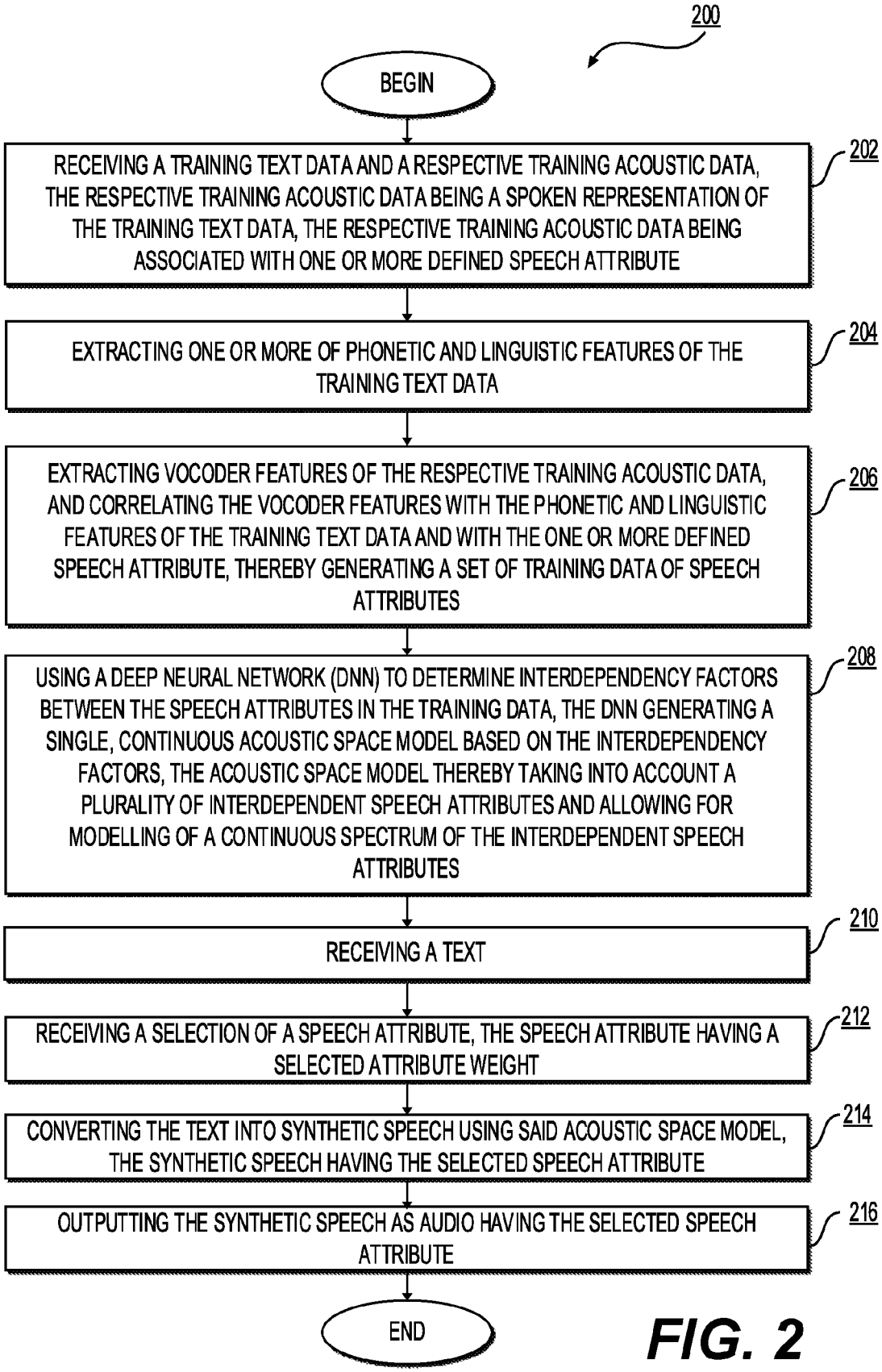
FIG. 2 depicts a block-diagram of a method executable within the system of FIG. 1 and implemented in accordance with non-limiting embodiments of the present technology.

FIG. 2 illustrates a computer-implemented method 200 for text-to-speech (TTS) synthesis, the method executable on a computing device (which can be either the client device 112 or the server 102) of the system 100 of FIG. 1.

The method 200 begins with steps 202-208 for training an acoustic space model which is used for TTS in accordance with embodiments of the technology. For ease of understanding, these steps are described with reference to FIG. 3, which depicts a schematic diagram 300 of training an acoustic space model 340 from source text 312 and acoustic data 322 in accordance with non-limiting embodiments of the present technology.

Step 202—Receiving a Training Text Data and a Respective Training Acoustic Data, the Respective Training Acoustic Data being a Spoken Representation of the Training Text Data, the Respective Training Acoustic Data being Associated with One or More Defined Speech Attribute The method 200 starts at step 202, where a computing device, being in this implementation of the present technology the server 102, receives instruction for TTS, specifically to output a synthetic speech having a selected speech attribute.

It should be expressly understood that, although the method 200 is described here with reference to an embodiment where the computing device is a server 102, this description is presented by way of example only, and the method 200 can be implemented mutatis mutandis in other embodiments, such as those where the computing device is a client device 112.

In step 202, training text data 312 is received. The form of the training text data 312 is not particularly limited. It may be part of a written text of any type, e.g., a book, an article, an e-mail, a text message, and the like. The training text data 312 is received via text input 130 and input module 113. It may be received from an e-mail client, an e-book reader, a messaging system, a web browser, or within another application containing text content. Alternatively, the training text data 312 may be received from the operating system of the computing device (e.g., the server 102, or the client device 112).

Training acoustic data 322 is also received. The training acoustic data 322 is a spoken representation of the training text data 312 and is not particularly limited. It may be a recording of a person reading aloud the training text 312, a speech, a play, a song, a video, and the like.

The training acoustic data 322 is associated with one or more defined speech attribute 326. The defined speech attribute 326 is not particularly limited and may correspond, for example, to an emotion (angry, happy, sad, etc.), the gender of the speaker, an accent, an intonation, a dynamic, a speaker identity, etc. For each training acoustic data 322 received, the one or more speech attribute 326 is defined, to allow correlation between vocoder features 324 of the acoustic data 322 and speech attributes 326 during training of the acoustic space model 340 (defined further below).

The form of the training acoustic data 322 is not particularly limited. It may be part of an audio sample of any type, e.g., a recording, a speech, a video, and the like. The training acoustic data 322 is received via an audio input (not depicted) and input module 113. It may be received from an application containing audio content. Alternatively, the training acoustic data 322 may be received from the operating system of the computing device (e.g., the server 102, or the client device 112).

Training text data 312 and training acoustic data 322 can originate from multiple sources. For example, text and/or acoustic data 312, 322 could be retrieved from email messages, downloaded from a remote server, and the like. In some non-limiting implementations, text and/or acoustic data 312, 322 is stored in the information storage medium 104, e.g., in database 106. In alternative non-limiting implementations, text and/or acoustic data 312, 322 is received (e.g., uploaded) by the server 102 from the client device 112 via the communication network 110. In yet another non-limiting implementation, text and/or acoustic data 312, 322 is retrieved (e.g., downloaded) from an external resource (not depicted) via the communication network 110.

In this implementation of the present technology, the server 102 acquires the text and/or acoustic data 312, 322 from an external resource (not depicted), which can be, for example, a provider of such data. In other implementations of the present technology, the source of the text and/or acoustic data 312, 322 can be any suitable source, for example, any device that optically scans text images and converts them to a digital image, any device that records audio samples, and the like.

Then, the method 200 proceeds to the step 204.

Step 204—Extracting One or More of Phonetic and Linguistic Features of the Training Text Data Next, at step 204, the server 102 executes a step of extracting one or more of phonetic and linguistic features 314 of the training text data 312. This step is shown schematically in the first box 310 in FIG. 3. Phonetic and/or linguistic features 314 are also shown schematically in FIG. 3. Many such features and ways of extracting such features are known, and this step is not meant to be particularly limited. For example, in the non-limiting embodiment shown in FIG. 3, the training text data 312 is divided into phones, a phone being a minimal segment of a speech sound in a language. Phones are generally either vowels or consonants or small groupings thereof. In some embodiments, the training text data 312 may be divided into phonemes, a phoneme being a minimal segment of speech that cannot be replaced by another without changing meaning, i.e., an individual speech unit for a particular language. As will be understood by persons skilled in the art, extraction of phonetic and/or linguistic features 314 may be done using any known method or algorithm. The method to be used and the phonetic and/or linguistic features 314 to be determined may be selected using a number of different criteria, such as the source of the text data 312, etc.

Then, the method 200 proceeds to step 206.

Step 206—Extracting Vocoder Features of the Respective Training Acoustic Data, and Correlating the Vocoder Features with the Phonetic and Linguistic Features of the Training Text Data and with the One or More Defined Speech Attribute, Thereby Generating a Set of Training Data of Speech Attributes Next, at step 206, the server 102 executes a step of extracting vocoder features 324 of the training acoustic data 322. This step is shown schematically in the second box 320 in FIG. 3. Vocoder features 324 are also shown schematically in FIG. 3, as are defined speech attributes 326. Many such features and ways of extracting such features are known, and this step is not meant to be particularly limited. For example, in the non-limiting embodiment shown in FIG. 3, the training acoustic data 322 is divided into vocoder features 324. In some embodiments, extracting vocoder features 324 of the training acoustic data 322 comprises dimensionality reduction of the waveform of the respective training acoustic data. As will be understood by persons skilled in the art, extraction of vocoder features 324 may be done using any known method or algorithm. The method to be used may be selected using a number of different criteria, such as the source of the acoustic data 322, etc.

Next, the vocoder features 324 are correlated with the phonetic and/or linguistic features 314 of the training text data 312 determined in step 204 and with the one or more defined speech attribute 326 associated with the training acoustic data 322, and received in step 202. The phonetic and/or linguistic features 314, the vocoder features 324, and the one or more defined speech attribute 326 and the correlations therebetween form a set of training data (not depicted).

Then, the method 200 proceeds to the step 208.

Step 208—Using a Deep Neural Network to Determine Interdependency Factors Between the Speech Attributes in the Training Data, the Deep Neural Network Generating a Single, Continuous Acoustic Space Model Based on the Interdependency Factors, the Acoustic Space Model Thereby Taking into Account a Plurality of Interdependent Speech Attributes and Allowing for Modelling of a Continuous Spectrum of the Interdependent Speech Attributes In step 208, the server 102 uses a deep neural network (dnn) 330 to determine interdependency factors between the speech attributes 326 in the training data. The dnn 330 is a machine learning algorithm in which input nodes receive input and output nodes provide output, a plurality of hidden layers of nodes between the input nodes and the output nodes serving to execute a machine-learning algorithm. In contrast to a decision-tree based algorithm, the dnn 330 takes all of the training data into account simultaneously and finds interconnections and interdependencies between the training data, allowing for continuous, unified modelling of the training data. Many such dnns are known and the method of implementation of the dnn 330 is not meant to be particularly limited.

Figure 3:
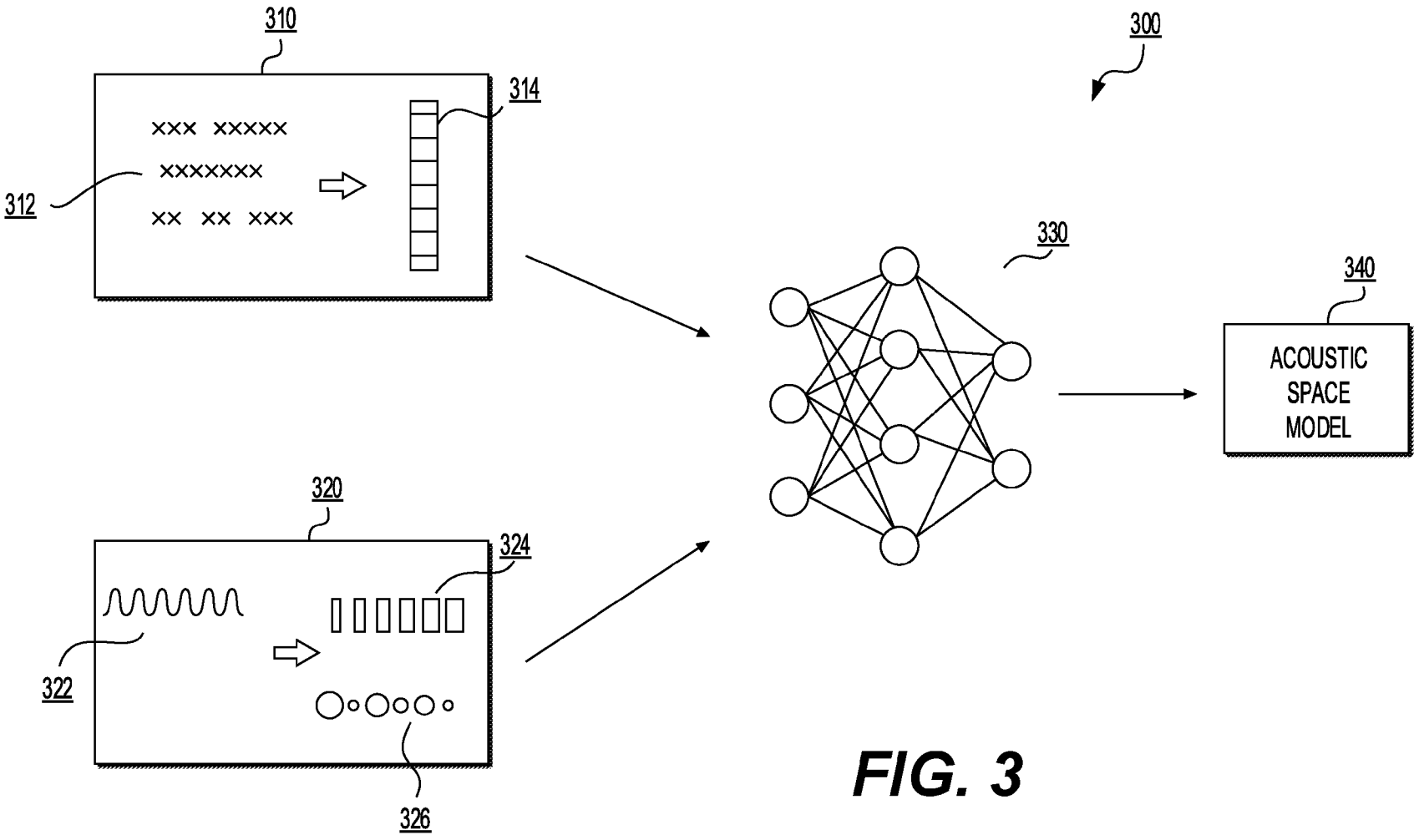
FIG. 3 depicts a schematic diagram of training an acoustic space model from source text and acoustic data in accordance with non-limiting embodiments of the present technology.
Figure 4:
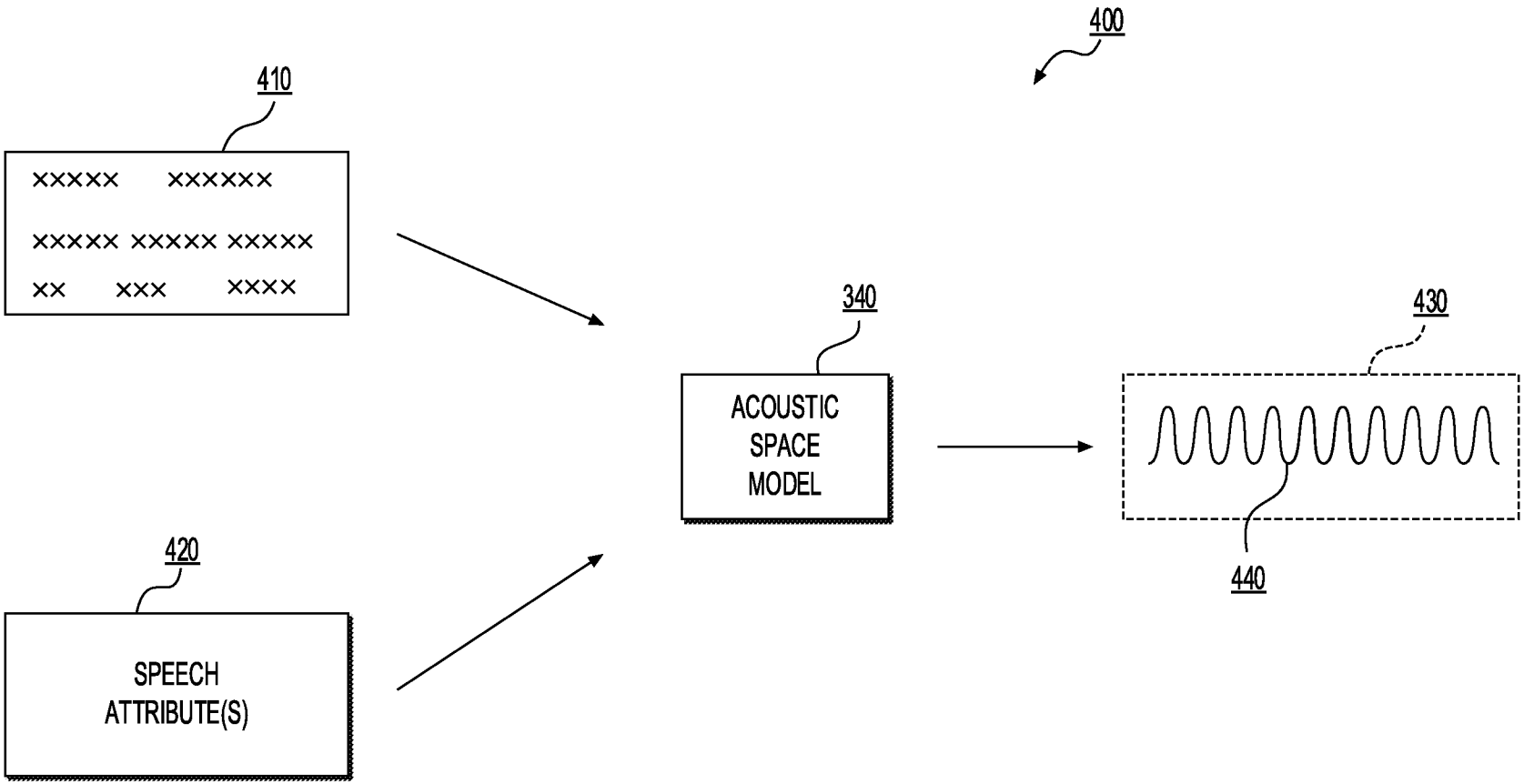
FIG. 4 depicts a schematic diagram of text-to-speech synthesis in accordance with non-limiting embodiments of the present technology.

In the non-limiting embodiment shown in FIG. 3, the input into the dnn 330 is the training data (not depicted), and the output from the dnn 330 is the acoustic space model 340. The dnn 330 thus generates a single, continuous acoustic space model 340 based on the interdependency factors between the speech attributes 326, the acoustic space model 340 thereby taking into account a plurality of interdependent speech attributes and allowing for modelling of a continuous spectrum of the interdependent speech attributes. The acoustic space model 340 can now be used in the remaining steps 210-216 of the method 200.

The method 200 now continues with steps 210-216 in which text-to-speech synthesis is performed, using the acoustic space model 340 generated in step 208. For ease of understanding, these steps are described with reference to FIG. 4, which depicts a schematic diagram 400 of text-to-speech synthesis (TTS) in accordance with non-limiting embodiments of the present technology.

Step 210—Receiving a Text

In step 210, a text 410 is received. As for the training text data 312, the form of the text 410 is not particularly limited. It may be part of a written text of any type, e.g., a book, an article, an e-mail, a text message, and the like. The text 410 is received via text input 130 and input module 113. It may be received from an e-mail client, an e-book reader, a messaging system, a web browser, or within another application containing text content. Alternatively, the text 410 may be received from the operating system of the computing device (e.g., the server 102, or the client device 112).

The method 200 now continues with step 212.

Step 212—Receiving a Selection of a Speech Attribute, the Speech Attribute Having a Selected Attribute Weight In step 212, a selection of a speech attribute 420 is received. One or more speech attribute 420 may be selected and received. Speech attribute 420 is not particularly limited and may correspond, for example, to an emotion (angry, happy, sad, etc.), the gender of the speaker, an accent, an intonation, a dynamic, a speaker identity, a speaking style, etc. For each training acoustic data 322 received, the one or more speech attribute 326 is defined, to allow correlation between vocoder features 324 of the acoustic data 322 and speech attributes 326 during training of the acoustic space model 340 (defined further below).

Each speech attribute 326 has a selected attribute weight (not depicted). The selected attribute weight defines the weight of the speech attribute desired in the synthetic speech 440. The weight is applied for each speech attribute 326, the outputted synthetic speech 440 having a weighted sum of speech attributes. It will be understood that, in the non-limiting embodiment where only one speech attribute 420 is selected, the selected attribute weight for the single speech attribute 420 is necessarily 1 (or 100%). In alternative embodiments, where two or more selected speech attributes 420 are received, each selected speech attribute 420 having a selected attribute weight, the outputted synthetic speech 440 will have a weighted sum of the two or more selected speech attributes 420.

The selection of the speech attribute 420 is received via the input module 113. In some non-limiting embodiments, it may be received with the text 410 via the text input 130. In alternative embodiments, the text 410 and the speech attribute 420 are received separately (e.g., at different times, or from different applications, or from different users, or in different files, etc.), via the input module 113.

Step 214—Converting the Text into Synthetic Speech Using the Acoustic Space Model, the Synthetic Speech Having the Selected Speech Attribute In step 214, the text 410 and the one or more speech attribute 420 are inputted into the acoustic space model 340. The acoustic space model 340 converts the text into synthetic speech 440. The synthetic speech 440 has perceivable characteristics 430. The perceivable characteristics 430 correspond to vocoder or audio features of the synthetic speech 440 that are perceived as corresponding to the selected speech attribute(s) 420. For example, where the speech attribute "angry" has been selected, the synthetic speech 440 has a waveform whose frequency characteristics (in this example, the frequency characteristics being the perceivable characteristics 430) produce sound that is perceived as "angry", the synthetic speech 440 therefore having the selected speech attribute "angry".

Step 216—Outputting the Synthetic Speech as Audio Having the Selected Speech Attribute The method 200 ends with step 216, in which the synthetic speech 440 is outputted as audio having the selected speech attribute(s) 420. As described above with reference to step 214, the synthetic speech 440 produced by the acoustic space model 340 has perceivable characteristics 430, the perceivable characteristics 430 producing sound having the selected speech attribute(s) 420.

In some implementations, where the computing device is a server 102 (as in the implementation depicted here), the method 200 may further comprise a step (not depicted) of sending, to client device 112, an instruction to output the synthetic speech 440 via output module 118 and audio output 140 of the client device 112. In some implementations, the instruction to output the synthetic speech 440 via the audio output 140 of the client device 112 comprises an instruction to read a text message received on the client device 112 out loud to the user 121, so that the user 121 is not required to look at the client device 112 in order to receive the text message. For example, the instruction to output the synthetic speech 440 on client device 112 may be part of an instruction to read a text message. In such a case, the text 410 received in step 210 may also be part of an instruction to convert incoming text messages to audio. Many alternative implementations are possible. For example, the instruction to output the synthetic speech 440 on client device 112 may be part of an instruction to read an e-book out loud, read an email message out loud, read back to the user 121 a text that the user has entered, to verify the accuracy of the text, and so on.

In some implementations, where the computing device is a server 102 (as in the implementation depicted here), the method 200 may further comprise a step (not depicted) of outputting the synthetic speech 440 via a second output module (not depicted). The second output module (not depicted) may, for example, be part of the server 102, e.g. connected to the network communication interface 109 and the processor 108. In some embodiments, instruction to output the synthetic speech 440 via output module 118 and audio output 140 of the client device 112 is sent to client device 112 via the second output module (not depicted) in the server 102.

In alternative implementations, where the computing device is a client device 112, the method 200 may further comprise a step of outputting the synthetic speech 440 via output module 118 and audio output 140 of the client device 112. In some implementations, the instruction to output the synthetic speech 440 via the audio output 140 of the client device 112 comprises an instruction to read a text message received on the client device 112 out loud to the user 121, so that the user 121 is not required to look at the client device 112 in order to receive the text message. For example, the instruction to output the synthetic speech 440 on client device 112 may be part of an instruction to read a text message. In such a case, the text 410 received in step 210 may also be part of an instruction to convert incoming text messages to audio. Many alternative implementations are possible. For example, the instruction to output the synthetic speech 440 on client device 112 may be part of an instruction to read an e-book out loud, read an email message out loud, read back to the user 121 a text that the user has entered, to verify the accuracy of the text, and so on.

In some implementations, the method 200 ends after step 216. For example, if the received text 410 has been outputted as synthetic speech 440, then the method 200 ends after step 216. In alternative implementations, steps 210 to 216 may be repeated. For example, a second text (not depicted) may be received, along with a second selection of one or more speech attribute (not depicted). In this case, the second text is converted into a second synthetic speech (not depicted) using the acoustic space model 340, the second synthetic speech having the second selected one or more speech attribute, and the second synthetic speech is outputted as audio having the second selected one or more speech attribute. Steps 210 to 216 may be repeated until all desired texts have been converted to synthetic speech having the selected one ore more speech attribute. In such implementations the method is therefore recursive, repeatedly converting texts into synthetic speech and outputting the synthetic speech as audio until every desired text has been converted and outputted.

Some of the above steps and signal sending-receiving are well known in the art and, as such, have been omitted in certain portions of this description for the sake of simplicity. The signals can be sent/received using optical means (such as a fibre-optic connection), electronic means (such as using wired or wireless connection), and mechanical means (such as pressure-based, temperature based or any other suitable physical parameter based means).

Some technical effects of non-limiting embodiments of the present technology may include provision of a fast, efficient, versatile, and/or affordable method for text-to-speech synthesis. In some embodiments, the present technology allows provision of TTS with a programmatically selected voice. For example, in some embodiments, synthetic speech can be outputted having any combination of selected speech attributes. In such embodiments, the present technology can thus be flexible and versatile, allowing a programmatically selected voice to be outputted. In some embodiments, the combination of speech attributes selected is independent of the speech attributes in the training acoustic data. For example, suppose a first training acoustic data having the speech attributes "angry male" and a second training acoustic data having the speech attributes "young female, happy" are received during training of the acoustic space model; nevertheless, the speech attributes "angry" and "female" can be selected, and synthetic speech having the attributes "angry female" can be outputted. Further, arbitrary weights for each speech attribute can be selected, depending on the voice characteristics desired in the synthetic speech. In some embodiments, therefore, a synthetic speech can be outputted, even if no respective training acoustic data with the selected attributes was received during training. Further, the text converted to synthetic speech need not correspond to the training text data, and a text can be converted to synthetic speech even though no respective acoustic data for that text was received during the training process. At least some of these technical effects are achieved through building an acoustic model that is based on interdependencies of the attributes of the acoustic data. In some embodiments, the present technology may provide synthetic speech that sounds like a natural human voice, having the selected speech attributes.

It should be expressly understood that not all technical effects mentioned herein need to be enjoyed in each and every embodiment of the present technology. For example, embodiments of the present technology may be implemented without the user enjoying some of these technical effects, while other embodiments may be implemented with the user enjoying other technical effects or none at all.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

From a certain perspective, embodiments of the present technology can be summarized as follows, structured in numbered clauses:

CLAUSE 1. A method for text-to-speech synthesis configured to output a synthetic speech (440) having a selected speech attribute (420), the method executable at a computing device, the method comprising the steps of:

a) receiving a training text data (312) and a respective training acoustic data (322), the respective training acoustic data (322) being a spoken representation of the training text data (312), the respective training acoustic data (322) being associated with one or more defined speech attribute (326);

b) extracting one or more of phonetic and linguistic features (314) of the training text data (312);

c) extracting vocoder features (324) of the respective training acoustic data (322), and correlating the vocoder features (324) with the phonetic and linguistic features (314) of the training text data (312) and with the one or more defined speech attribute (326), thereby generating a set of training data of speech attributes;

d) using a deep neural network (dnn) (330) to determine interdependency factors between the speech attributes (326) in the training data, the dnn (330) generating a single, continuous acoustic space model (340) based on the interdependency factors, the acoustic space model (340) thereby taking into account a plurality of interdependent speech attributes and allowing for modelling of a continuous spectrum of the interdependent speech attributes;

e) receiving a text (410);

f) receiving a selection of a speech attribute (420), the speech attribute (420) having a selected attribute weight;

g) converting the text (410) into synthetic speech (440) using the acoustic space model (340), the synthetic speech (440) having the selected speech attribute (420); and h) outputting the synthetic speech (440) as audio having the selected speech attribute (420).

CLAUSE 2. The method of clause 1, wherein the extracting one or more of phonetic and linguistic features (314) of the training text data (312) comprises dividing the training text data (312) into phones.

CLAUSE 3. The method of clause 1 or 2, wherein the extracting vocoder features (324) of the respective training acoustic data (322) comprises dimensionality reduction of the waveform of the respective training acoustic data (322).

CLAUSE 4. The method of any one of clauses 1 to 3, wherein the one or more defined speech attribute (326) is an emotion, a gender, an intonation, an accent, a speaking style, a dynamic, or a speaker identity.

CLAUSE 5. The method of any one of clauses 1 to 4, wherein the selected speech attribute (420) is an emotion, a gender, an intonation, an accent, a speaking style, a dynamic, or a speaker identity.

CLAUSE 6. The method of any one of clauses 1 to 5, wherein a selection of two or more speech attributes (420) is received, each selected speech attribute (420) having a respective selected attribute weight, and the outputted synthetic speech (440) having each of the two or more selected speech attributes (420).

CLAUSE 7. The method of any one of clauses 1 to 6, further comprising the steps of: receiving a second text; receiving a second selected speech attribute, the second selected speech attribute having a second selected attribute weight; converting the second text into a second synthetic speech using the acoustic space model, (340) the second synthetic speech having the second selected speech attribute; and outputting the second synthetic speech as audio having the second selected speech attribute.

CLAUSE 8. A server (102) comprising:

an information storage medium (104);

a processor (108) operationally connected to the information storage medium (104), the processor (108) configured to store objects on the information storage medium (104), the processor (108) being further configured to:

a) receive a training text data (312) and a respective training acoustic data (322), the respective training acoustic data (322) being a spoken representation of the training text data (312), the respective training acoustic data (322) being associated with one or more defined speech attribute (326);

b) extract one or more of phonetic and linguistic features (314) of the training text data (312);

c) extract vocoder features (324) of the respective training acoustic data (322), and correlate the vocoder features (324) with the phonetic and linguistic features (314) of the training text data (312) and with the one or more defined speech attribute (326), thereby generating a set of training data of speech attributes;

d) use a deep neural network (dnn) (330) to determine interdependency factors between the speech attributes (326) in the training data, the dnn (330) generating a single, continuous acoustic space model (340) based on the interdependency factors, the acoustic space model (340) thereby taking into account a plurality of interdependent speech attributes and allowing for modelling of a continuous spectrum of the interdependent speech attributes;

e) receive a text (410);

f) receive a selection of a speech attribute (420), the speech attribute (420) having a selected attribute weight;

g) convert the text (410) into synthetic speech (440) using the acoustic space model (340), the synthetic speech (440) having the selected speech attribute (420); and h) output the synthetic speech (440) as audio having the selected speech attribute (420).

CLAUSE 9. The server of clause 8, wherein the extracting one or more of phonetic and linguistic features (314) of the training text data (312) comprises dividing the training text data (312) into phones.

CLAUSE 10. The server of clause 8 or 9, wherein the extracting vocoder features (324) of the respective training acoustic data (322) comprises dimensionality reduction of the waveform of the respective training acoustic data (322).

CLAUSE 11. The server of any one of clauses 8 to 10, wherein the one or more defined speech attribute (326) is an emotion, a gender, an intonation, an accent, a speaking style, a dynamic, or a speaker identity.

CLAUSE 12. The server of any one of clauses 8 to 11, wherein the selected speech attribute (420) is an emotion, a gender, an intonation, an accent, a speaking style, a dynamic, or a speaker identity.

CLAUSE 13. The server of any one of clauses 8 to 12, wherein the processor (108) is further configured to receive a selection of two or more speech attributes (420), each selected speech attribute (420) having a respective selected attribute weight, and to output the synthetic speech (440) having each of the two or more selected speech attributes (420).

CLAUSE 14. The server of any one of clauses 8 to 13, wherein the processor (108) is further configured to: receive a second text; receive a second selected speech attribute, the second selected speech attribute having a second selected attribute weight; convert the second text into a second synthetic speech using the acoustic space model (340), the second synthetic speech having the second selected speech attribute; and output the second synthetic speech as audio having the second selected speech attribute.

What is claimed is:

1. A method for text-to-speech synthesis configured to output a synthetic speech having two or more selected speech attributes, the method executable at a computing device, the method comprising the steps of:

a) receiving a training text data and a respective training acoustic data, the respective training acoustic data being a spoken representation of the training text data, the respective training acoustic data being associated with one or more defined speech attribute;

b) extracting one or more of phonetic and linguistic features of the training text data;

c) extracting vocoder features of the respective training acoustic data, and correlating the vocoder features with the phonetic and linguistic features of the training text data and with the one or more defined speech attribute, thereby generating a set of training data of speech attributes;

d) using a deep neural network (dnn) to determine interdependency factors between the speech attributes in the training data, the dnn generating a single, continuous acoustic space model based on the interdependency factors, the acoustic space model thereby taking into account a plurality of interdependent speech attributes and allowing for modelling of a continuous spectrum of the interdependent speech attributes;

e) receiving a text;

f) receiving a selection of the two or more speech attributes, the two or more selected speech attributes having respective selected attribute weights desired in a synthetic speech to be outputted;

g) converting the text into the synthetic speech using said acoustic space model, the synthetic speech having a weighted sum of the two or more selected speech attributes; and h) outputting the synthetic speech as audio having the two or more speech attributes having the respective selected attribute weights desired in the synthetic speech.

2. The method of claim 1, wherein said extracting one or more of phonetic and linguistic features of the training text data comprises dividing the training text data into phones.

3. The method of claim 1, wherein said extracting vocoder features of the respective training acoustic data comprises dimensionality reduction of the waveform of the respective training acoustic data.

4. The method of claim 1, wherein said one or more defined speech attribute is an emotion, a gender, an intonation, an accent, a speaking style, a dynamic, or a speaker identity.

5. The method of claim 1, wherein one of the two ore more speech attributes is an emotion, a gender, an intonation, an accent, a speaking style, a dynamic, or a speaker identity.

6. The method of claim 1, further comprising the steps of: receiving a second text; receiving a second selected speech attribute, the second selected speech attribute having a second selected attribute weight; converting the second text into a second synthetic speech using said acoustic space model, the second synthetic speech having the second selected speech attribute; and outputting the second synthetic speech as audio having the second selected speech attribute.

7. A server comprising:

an information storage medium;

a processor operationally connected to the information storage medium, the processor configured to store objects on the information storage medium, the processor being further configured to:

a) receive a training text data and a respective training acoustic data, the respective training acoustic data being a spoken representation of the training text data, the respective training acoustic data being associated with one or more defined speech attribute;

b) extract one or more of phonetic and linguistic features of the training text data;

c) extract vocoder features of the respective training acoustic data, and correlate the vocoder features with the phonetic and linguistic features of the training text data and with the one or more defined speech attribute, thereby generating a set of training data of speech attributes;

d) use a deep neural network (dnn) to determine interdependency factors between the speech attributes in the training data, the dnn generating a single, continuous acoustic space model based on the interdependency factors, the acoustic space model thereby taking into account a plurality of interdependent speech attributes and allowing for modelling of a continuous spectrum of the interdependent speech attributes;

e) receive a text;

f) receive a selection of two or more speech attributes, the two or more selected speech attributes having weight respective selected attribute weights desired in a synthetic speech to be outputted;

g) convert the text into the synthetic speech using said acoustic space model, the synthetic speech having a weighted sum of the two or more selected speech attributes; and h) output the synthetic speech as audio having the two or more speech attributes having the respective selected attribute weights desired in the synthetic speech.

8. The server of claim 7, wherein said extracting one or more of phonetic and linguistic features of the training text data comprises dividing the training text data into phones.

9. The server of claim 7, wherein said extracting vocoder features of the respective training acoustic data comprises dimensionality reduction of the waveform of the respective training acoustic data.

10. The server of claim 7, wherein said one or more defined speech attribute is an emotion, a gender, an intonation, an accent, a speaking style, a dynamic, or a speaker identity.

11. The server of claim 7, wherein one of the two or more speech attributes is an emotion, a gender, an intonation, an accent, a speaking style, a dynamic, or a speaker identity.

12. The server of claim 7, wherein the processor is further configured to: receive a second text; receive a second selected speech attribute, the second selected speech attribute having a second selected attribute weight; convert the second text into a second synthetic speech using said acoustic space model, the second synthetic speech having the second selected speech attribute; and output the second synthetic speech as audio having the second selected speech attribute.

* * * * *